US010323601B2

(12) United States Patent
Zahdeh et al.

(10) Patent No.: US 10,323,601 B2
(45) Date of Patent: Jun. 18, 2019

(54) COOLING JACKET FOR CYLINDER HEAD

(71) Applicant: GM GLOBAL TECHNOLOGY OPERATIONS LLC

(72) Inventors: Akram R. Zahdeh, Rochester Hills, MI (US); Dan L. Alden, Howell, MI (US); Alan W. Hayman, Romeo, MI (US)

(73) Assignee: GM Global Technology Operations LLC, Detroit, MI (US)

( * ) Notice: Subject to any disclaimer, the term of this patent is extended or adjusted under 35 U.S.C. 154(b) by 0 days.

(21) Appl. No.: 15/728,715

(22) Filed: Oct. 10, 2017

(65) Prior Publication Data

US 2019/0107075 A1 Apr. 11, 2019

(51) Int. Cl.

| | |
|---|---|
| ***F02F 1/40*** | (2006.01) |
| *F02F 1/24* | (2006.01) |
| *F01P 3/02* | (2006.01) |
| *F02F 1/42* | (2006.01) |

(52) U.S. Cl.

CPC ..... *F02F 1/40* (2013.01); *F01P 3/02* (2013.01); *F01P 2003/024* (2013.01); *F02F 1/242* (2013.01); *F02F 1/4285* (2013.01)

(58) Field of Classification Search

CPC .. F02F 1/40; F02F 1/242; F02F 1/4285; F02F 1/36; F02F 1/38; F01P 3/02; F01P 2003/024; F01P 3/12; F01P 3/14; F01P 3/16

See application file for complete search history.

(56) References Cited

U.S. PATENT DOCUMENTS

| | | | | |
|---|---|---|---|---|
| 2003/0221641 | A1* | 12/2003 | Oh | F02F 1/40 123/41.82 R |
| 2011/0315098 | A1* | 12/2011 | Kosugi | B22C 9/103 123/41.74 |
| 2012/0132155 | A1* | 5/2012 | Smith | F01P 3/02 123/41.79 |
| 2016/0258381 | A1* | 9/2016 | Tempesta | F02F 1/40 |

OTHER PUBLICATIONS

Shaikat. "Jacket Water Cooling System." HFO Power Plant. May 15, 2011. Accessed Oct. 9, 2017. http://hfoplant.blogspot.com/2011/05/jacket-water-cooling-system.html., 2 pages.

* cited by examiner

*Primary Examiner* — Jacob M Amick
(74) *Attorney, Agent, or Firm* — Reising Ethington P.C.; James Howard

(57) ABSTRACT

A cooling jacket for an engine has upper and lower bodies. The upper body includes a plurality of upper portions. Each upper portion has a top orifice and a bottom orifice. The lower body is located below the upper body and includes a plurality of lower portions. Each lower portion has a lower orifice aligned with a respective one of the bottom orifices so as to permit a coolant to flow through the lower orifice and into the bottom orifice. The coolant flows from that lower portion to the respective one of the upper portions. Each upper portion has at least one upper passageway extending through that upper portion from the bottom orifice to the top orifice so that the coolant entering the upper passageway of that upper portion flows through the upper portion to the top orifice.

19 Claims, 4 Drawing Sheets

COOLING JACKET FOR CYLINDER HEAD

INTRODUCTION

The present disclosure relates to cooling jackets used within the cylinder head of an internal combustion engine.

Typical vehicle internal combustion engines contain a plurality of engine cylinders formed within a cylinder block and enclosed by a cylinder head. A mixture of air and fuel combusts within the cylinders to produce drive torque and, as a result, generate heat. Engine cooling systems provide fluid flow to dissipate and/or reroute this generated heat. If the engine cylinders are not appropriately cooled, this can lead to increased wear and reduced engine life.

SUMMARY

According to an aspect of the disclosure, a cooling jacket for an engine, having a cylinder head with upper and lower ends, includes an upper body and a lower body. The upper body is configured to fit between the upper and lower ends of the cylinder head and includes a plurality of upper portions. Each upper portion has a top orifice and a bottom orifice formed therein. The lower body is located below the upper body, the lower body including a plurality of lower portions. Each lower portion is associated with a respective one of the upper portions and has a lower orifice formed therein and aligned with a respective one of the bottom orifices so as to permit a coolant to flow through the lower orifice and into the bottom orifice such that the coolant flows from that lower portion to the respective one of the upper portions. Each upper portion has at least one upper passageway extending through that upper portion from the bottom orifice to the top orifice so that the coolant entering the upper passageway of that upper portion flows through the upper portion to the top orifice.

In one example, the lower body includes a coolant inlet and a first longitudinal section that fluidly connects the coolant inlet to each of the lower orifices. The lower body includes a coolant outlet fluidly connected via the first longitudinal section and a second longitudinal section of the lower body to the coolant inlet such that one portion of the coolant flows from the coolant inlet, through the first longitudinal section, through the lower orifices, and into the upper passageways, and another portion of the coolant flows from the coolant inlet, through the second longitudinal section, and to the coolant outlet. In this manner, the cooling jacket includes a first set of parallel coolant flow paths through the upper body and a second set of parallel coolant flow paths through the lower bodies.

The cooling jacket optionally includes an exit body fluidly coupled to the upper and lower bodies and to redistribute heat from the coolant to one of engine oil, transmission oil, or a vehicle cabin, and each upper passageway is formed from the lower body, into the upper body, and out the exit body. The upper passageway of each upper portion is isolated from the upper passageway of the other upper portions. The cooling jacket is optionally configured to distribute an equal amount of the coolant to each of the upper passageways.

In one example, the lower body further includes a plurality of lower passageways therethrough. Each lower portion has a spark plug opening for a spark plug, an exhaust opening for an exhaust gas valve, and an intake opening for an air intake valve, and each lower passageway permits the coolant to flow from a location adjacent the spark plug opening, to a location adjacent the exhaust opening, and to a location adjacent the intake opening, respectively. The upper and lower bodies may be formed substantially within the cylinder head and in a single casting.

According to another aspect of the disclosure, a cooling jacket for an engine, having a plurality of cylinders and a cylinder head with upper and lower ends, includes the upper body configured to fit between the upper and lower ends and including a plurality of upper portions. Each upper portion has a top orifice and a bottom orifice formed therein and surrounds respective valves for one of the cylinders.

The cooling jacket also includes the lower body located below the upper body. The lower body has a plurality of lower portions, each lower portion being associated with a respective one of the upper portions and having a lower orifice formed therein and aligned with a respective one of the bottom orifices. Each lower portion also has a plurality of openings including an exhaust opening for an exhaust gas valve and an intake opening for an air intake valve. Further, each lower portion has at least one lower passageway extending through that lower portion from an entry adjacent the exhaust opening to an exit adjacent the intake opening so that the coolant entering the lower passageway of that lower portion flows from the entry to the exit.

Similarly to the first aspect discussed above, each lower portion optionally has a spark plug opening for a spark plug, and each lower passageway surrounds the spark plug, exhaust, and intake openings and permits the coolant to flow from a location adjacent the spark plug opening, to a location adjacent the exhaust opening, and to a location adjacent the intake opening, respectively. The upper and lower bodies may be formed substantially within the cylinder head and in a single casting.

In one example, coolant flows in the lower passageways during both a vehicle warm-up mode and a wide open throttle mode. The plurality of lower portions can be arranged in-line with each other. Further, the lower passageway of each lower portion is optionally isolated from the lower passageway of the other lower portions, and the cooling jacket is configured to distribute an equal amount of the coolant to each of the lower passageways. Optionally, each cylinder has only one exhaust gas valve and only one air intake valve. The upper and lower bodies surround the respective valves for one of the cylinders and extract heat and lower a temperature around the only one exhaust gas valve, whereby the cooling jacket improves fuel efficiency during the wide open throttle mode.

According to yet another aspect of the disclosure, an engine includes a cylinder head having upper and lower ends, a plurality of in-line cylinders arranged adjacent to the cylinder head, and a cooling jacket having all or any of the features described herein. For example, the cooling jacket has an upper body configured to fit between the upper and lower ends and including a plurality of upper portions. Each upper portion has a top orifice and a bottom orifice formed therein and surrounds respective valves for one of the cylinders. The cooling jacket also has a lower body located below the upper body and including a plurality of lower portions. Each lower portion is associated with a respective one of the upper portions and has a lower orifice formed therein and aligned with a respective one of the bottom orifices. Each lower portion also has a plurality of openings including an exhaust opening for an exhaust gas valve and an intake opening for an air intake valve.

Each upper portion has at least one upper passageway extending through that upper portion from the bottom orifice to the top orifice so that the coolant entering the upper passageway of that upper portion flows through the upper portion to the top orifice. Each lower portion has at least one lower passageway extending through that lower portion from an entry adjacent the exhaust opening to an exit adjacent the intake opening so that the coolant entering the lower passageway of that lower portion flows from the entry to the exit. The engine may further include an electric pump fluidly coupled to the cooling jacket for circulating coolant through the cooling jacket.

A velocity of coolant is substantially equal through each of the bottom and lower orifices. Further, the upper and lower bodies may be formed substantially within the cylinder head and in a single casting.

BRIEF DESCRIPTION OF THE DRAWINGS

One or more aspects of the disclosure will hereinafter be described in conjunction with the appended drawings, wherein like designations denote like elements, and wherein.

DETAILED DESCRIPTION

Figure 1:
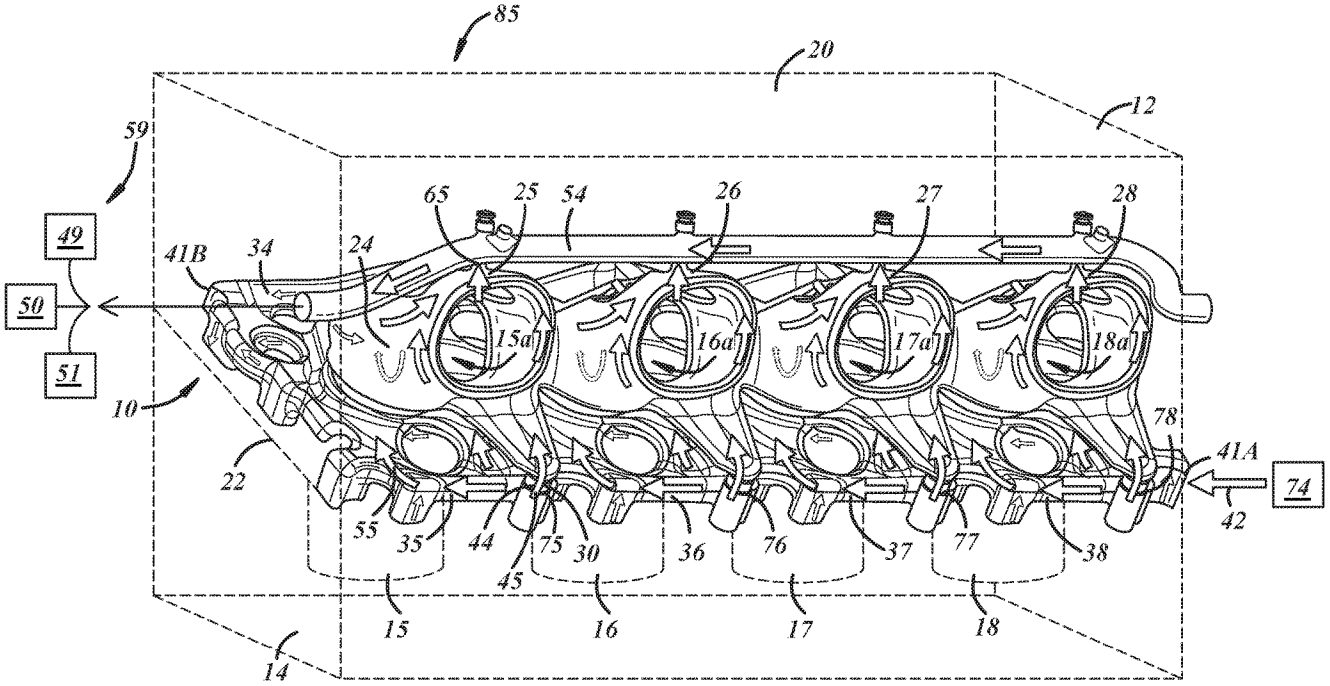
FIG. 1 is a side view of a cylinder head and a cylinder block for an engine having a cooling jacket, according to an exemplary embodiment.

Internal combustion engines are cooled via cooling systems that circulate coolant through a water or cooling jacket. FIG. 1 depicts a portion of an engine, which contains an exemplary cooling jacket 10. Cooling jacket 10 is located generally between the upper and lower ends (20, 22) of the cylinder head 12 and includes various passageways, or coolant galleries, for coolant to flow. As coolant flows through these passageways, it dissipates and/or reroutes heat generated by combustion.

Adjacent and underneath the cylinder head 12 is the cylinder block 14, containing a plurality of engine cylinders (15, 16, 17, 18). Each cylinder is associated with various valves (15*a*, 16*a*, 17*a*, 18*a*) of the valve train, which control the flow and timing of the inlet and exit of gases that enter and exit the combustion chambers. Cooling jacket 10 surrounds the various valves (15*a*, 16*a*, 17*a*, 18*a*) and other portions of each cylinder (15, 16, 17, 18) so that the heat generated is either dissipated or moved to another location within the vehicle where it can be used. The various open arrows in the figures described herein depict details of the passageways and flow paths that coolant can flow in throughout the cooling jacket.

More specifically, cooling jacket 10 has an upper body 24 and a lower body 34. The upper and lower bodies may also be referred to as cores, which assist in regulating heat within the engine. The upper body 24 is configured to fit between the upper and lower ends (20, 22) of the cylinder head 12 and has a plurality of upper portions (25, 26, 27, 28). Each upper portion corresponds or is associated with one of the engine cylinders (15, 16, 17, 18), respectively. Each upper portion (e.g., upper portion 25) has a top orifice (e.g., top orifice 65) and at least one bottom orifice (e.g., bottom orifice 30) formed therein. In one example, each upper portion has two bottom orifices formed therein, one on an exterior side 84 of the engine and the other on an interior side 85 of the engine.

The lower body 34 is located below the upper body 24 in the engine and contains a plurality of lower portions (35, 36, 37, 38). Each lower portion (35, 36, 37, 38) corresponds or is associated with one of the upper portions (25, 26, 27, 28) and one of the engine cylinders (15, 16, 17, 18), respectively. Each lower portion has at least one lower orifice (75, 76, 77, 78) formed therein and aligned with a respective one of the bottom orifices so as to permit a coolant 42 to flow through the lower orifice (e.g., lower orifice 75) and into the bottom orifice (e.g., bottom orifice 30) such that the coolant 42 flows from the lower portion (e.g., lower portion 35) to the respective one of the upper portions (e.g., upper portion 25). By having upper and lower portions and their associated orifices, the cooling jacket 10 forms a plurality of passageways for coolant 42 to flow within the engine.

More specifically, each upper portion (25, 26, 27, 28) has at least one upper passageway (e.g., upper passageway 45) extending through that particular upper portion. Each upper passageway extends from the associated bottom orifice (e.g., bottom orifice 30) to the top orifice (e.g., top orifice 65) so that the coolant 42 entering the upper passageway of that upper portion flows through the upper portion to the top orifice.

Because each upper portion surrounds respective valves of the valve train, each upper portion forms a circular opening (e.g., around valves 15*a*). Likewise, each upper passageway includes a V-shaped section from the bottom orifice on the exterior side 84 of the engine and a V-shaped section from the bottom orifice on the interior side 85 of the engine (obscured in FIG. 1). The V-shaped sections of each upper passageway split into two curved sections, which follow the circumferential path of the circular opening in each upper portion. The two curved sections on each respective side of the engine converge again to exit the top orifice (e.g., top orifice 65).

In order to distribute coolant 42 to the upper body 24, the cooling jacket 10 is fluidly coupled or connected to a pump 74 for circulating coolant 42 through the cooling jacket 10. The pump 74 can be a mechanical or electric pump. Speaking in general terms, mechanical pumps provide greater coolant flow than electric pumps. As a tradeoff, mechanical pumps obtain power from the engine itself, are operated at higher horsepower, and must be mounted within the engine. Electric pumps include their own electric motor, not drawing power from the engine, can be operated at a lower horsepower, and can be mounted remotely in the vehicle. This remote mounting frees up space within the engine and can lead to a longer pump life. All of these features lead to an electric pump providing improved fuel economy.

With the cooling jacket described herein, it is possible to use an electric pump, even though it has a lower flow rate when compared to a mechanical pump, and effectively cool the engine. The various passageways provide targeted cooling of the engine components and with the flow rate of an electric pump.

The pump 74 circulates coolant 42 into the lower body 34 at a coolant inlet 41A. The lower body 34 also includes a coolant outlet 41B, on the opposite side of the cooling jacket 10 from the coolant inlet 41A. The coolant outlet 41B is also fluidly connected via the various passageways in the lower body 34 to the coolant inlet 41A.

The cooling jacket 10 also includes an exit body 54 fluidly coupled to the upper and lower bodies (24, 34). With the upper, lower, and exit bodies, the cooling jacket is generally made in three main pieces. Of course, it is also possible to form the cooling jacket such that two or all of the three pieces are integrally formed into a single piece or from a single casting. Coolant 42, flowing through the upper passageways (e.g., upper passageway 45), exits out the top orifices (e.g., top orifice 65) and enters the exit body 54. In operation, the coolant 42 in the lower body 34 extracts heat from the various engine cylinders during combustion. This extraction will be discussed in further detail below. This hot coolant 42 subsequently enters the upper body. If the vehicle has been recently started, portions of the vehicle may be cold and in need of heating. The vehicle may be in a vehicle warm-up mode 59.

Contrastingly, the heat from combustion is not needed in the engine and desirably is removed from the engine. In this case, the hot coolant 42 that absorbs the engine heat can be routed out of the exit body 54 and redistributed, for example, to heat the engine oil 49, heat the transmission oil 50, and/or heat the vehicle cabin 51. By redistributing the heat from hot coolant during at least the vehicle warm-up mode 59, the cooling jacket allows thermal management of the heat within the vehicle. In this example, coolant 42 enters the lower body 34, flows into the upper body 24 through the plurality of upper portions (25, 26, 27, 28), and exits out the exit body 54 to be cooled and recirculated back to the cooling jacket 10.

The upper passageways and the exit body allow for engine cooling, while efficiently reusing and redistributing the heat from the hot coolant in other locations within the vehicle. In addition to the above discussion regarding coolant pumps, the higher flow rates of mechanical coolant pumps may not be as suited for redistributing and reusing the heat from hot coolant as the lower flow rates of electric pumps. Further, by increasing the efficiency at which heat is moved away from the engine, vehicles employing this cooling jacket may also include reduced size radiators. With a smaller radiator, the front of the vehicle does not need to accommodate as much equipment therein, leading to more design options for front fascias and other components.

As depicted in FIG. 1, each upper passageway (e.g., upper passageway 45) can be isolated from the other upper passageways so that coolant does not flow directly from one upper passageway to another. In this way, coolant enters each upper passageway in a parallel manner from the lower body 34. Each upper portion can contain steam holes located between adjacent upper portions to allow steam to escape and prevent voids in the coolant that can be detrimental to the engine's durability. However, these steam holes do not allow coolant to flow between adjacent upper portions.

In order to establish an equal amount of coolant into each upper passageway the various orifices in the cooling jacket can be precisely sized to allow flow equality. The pressure created by pump 74, coupled with the precise sizing of the orifices, can create flow velocity within the coolant jacket that can be equal or varied depending on the particular location within the jacket. The cooling jacket 10 can include a metering system that can automatically route coolant in different directions and through different passageways as needed. With this metering system, coolant 42 can be routed in an equal amount or in different amounts to and/or through each upper passageway. The metering system and its various sections and orifices can ensure equal flow distribution to each of the cylinders to enable balanced and measured heat extraction. The metering system within the cooling jacket 10 includes a variety of components to control coolant flow through the various passageways available. The available passageways may contain different amounts of coolant per the available volume at different times.

As one example, the cooling jacket includes the orifices described herein. The precise sizing of the orifices can control the flow and/or velocity of the coolant therethrough. When the velocity of the coolant is substantially equal around each cylinder, then the corresponding passageways in the cooling jacket have substantially equal flow therethrough. In this context, "substantially" means that a given velocity is no more than 20%, preferably no more than 10%, more preferably no more than 1%, more or less than another velocity or a stated value.

In addition to the orifices, a plurality of plugs 44 can assist in controlling coolant flow and velocity. During manufacturing, the cooling jacket 10 may be formed via a sand casting technique. In this technique, sand molds fill the various locations, or cores, within the engine that are intended for the cooling jacket. Subsequently, the sand is removed, leaving behind the various passageways. In order to form a connection between different components within the cooling jacket 10, the jacket may be subsequently glued and/or drilled to form a hole or orifice. Plugs 44 are positioned at these orifices to allow precise sizing of the hole formed, and to prevent leakage. The plugs 44 can all contain the same size holes, or plugs 44 of different size holes can be used at different locations within the cooling jacket. As shown in FIG. 1, plug 44 is positioned between upper portion 25 and lower portion 35 to precisely size the orifices (30, 75) therein.

Additionally, the pump 74 prevents backflow of the coolant from the upper body 24 back to the lower body 34. Being in closer physical proximity to the pump 74, the coolant flow through the lower body 34 will be at a higher pressure than coolant flow in the upper body 24. As discussed above, hot coolant can flow from the lower body 34, through a plurality of upper passageways in the upper body 24, and out the exit body 54. Once the hot coolant exits lower orifices (75, 76, 77, 78) and enters the upper passageways, the higher pressure of the lower body, due to friction and other pressure losses in the system, prevents the hot coolant from flowing back through the lower orifices (75, 76, 77, 78) and into the lower body 34.

Further, a hotter coolant has a slightly lower density than a cooler coolant of the same composition. As a substance cools, its molecular motion slows down and the molecules get slightly closer together, occupying a smaller volume and increasing density. Therefore, hotter coolant has a slightly lower density and rises to the top over cooler, denser coolant. This also creates a pressure differential in the upper body from the lower body to circulate the coolant. This is depicted with the semicircular or arched coolant flow, open arrows in FIG. 1.

Figure 2:
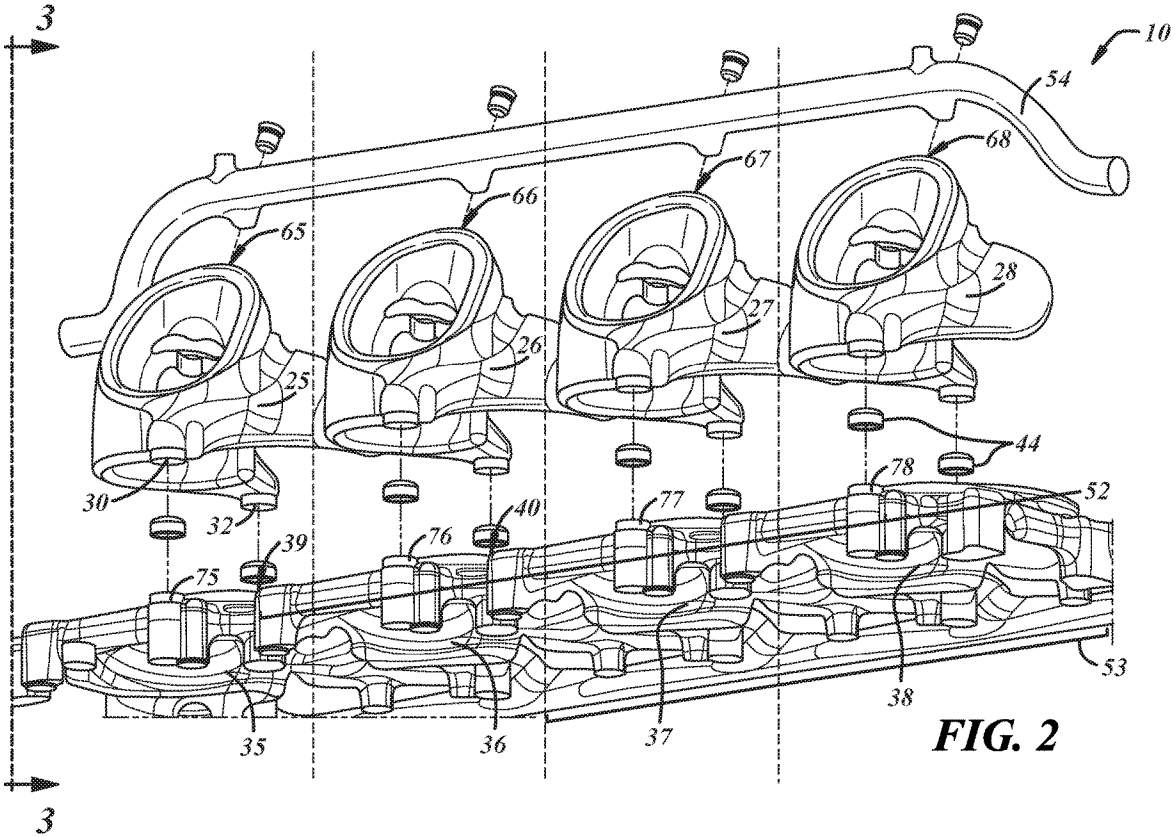
FIG. 2 is a front, exploded, perspective view of the cooling jacket of FIG. 1.

FIG. 2 is an exploded, perspective view of the cooling jacket 10 of FIG. 1, showing the exit body 54, upper portions (25, 26, 27, 28), lower portions (35, 36, 37, 38), and plugs 44. Additionally, FIG. 2 depicts a first longitudinal section 52 of the lower body, on the exterior side of the engine, and a second longitudinal section 53 of the lower body, on an interior side of the engine. The first longitudinal section 52 fluidly connects the coolant inlet to each of the lower orifices (75, 76, 77, 78). Coolant can flow from the lower orifices (75, 76, 77, 78), through the upper portions (25, 26, 27, 28), and out the top orifices (65, 66, 67, 68). The second longitudinal section 53 fluidly connects the coolant outlet to the first longitudinal section 52 and the coolant inlet.

In operation, the pump can move or circulate one portion of the coolant from the coolant inlet, through the first longitudinal section 52, through the lower orifices (75, 76, 77, 78), and into the upper passageways. The pump can also circulate another portion of the coolant from the coolant inlet, through the second longitudinal section 53, and to the coolant outlet. In this way, the cooling jacket includes parallel coolant flow paths, a first set of parallel coolant flow paths being through the upper body, as described above, and a second set of parallel coolant flow paths being through the lower body, as will be discussed in further detail below.

Figure 3:
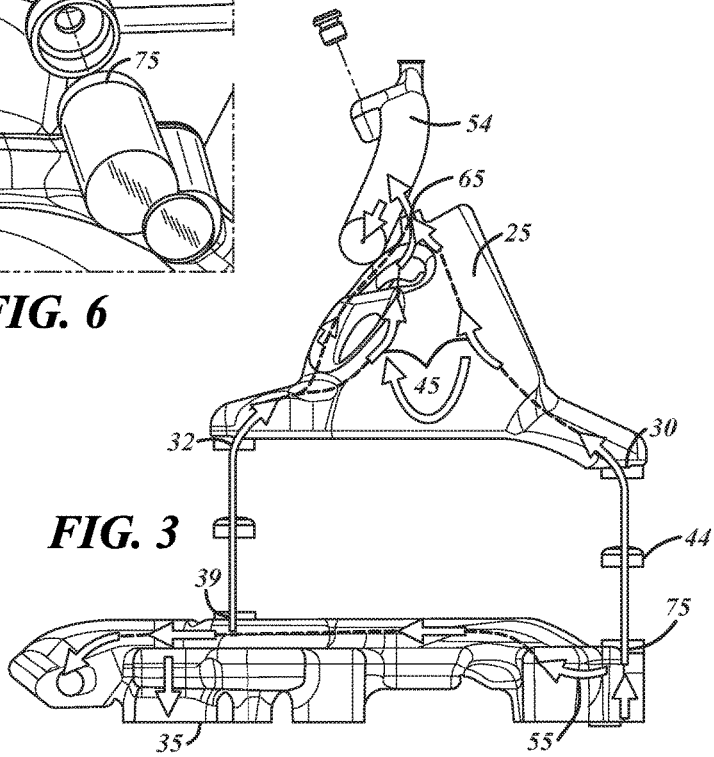
FIG. 3 is a cross-sectional view of the of the cooling jacket of FIG. 2, taken along line 3-3 in FIG. 2.

FIG. 3 depicts further details of one of the upper passageways 45 and a lower passageways 55 associated with lower portion 35. As described above, hot coolant can be directed through the upper body. On the exterior side of the engine, a portion of coolant can flow through the first lower and bottom orifices (75, 30), into the upper passageway 45, and out the top orifice 65.

Additionally at the same time on the interior side of the engine, a portion of coolant can flow through a second lower orifice 39, into a second bottom orifice 32, through the upper passageway 45, and out the top orifice 65. In this example, each lower portion (e.g., lower portion 35) has a first lower orifice 75 and a second lower orifice 39.

Further, each upper portion (e.g., upper portion 25) has a first bottom orifice 30, a second bottom orifice 32, and a top orifice 65. The first lower and bottom orifices (75, 30) are aligned, and the second lower and bottom orifices (39, 32) are aligned such that coolant flows from the lower portion 35 to the respective one of the upper portions 25 through both the first and second lower and bottom orifices (75, 39, 30, 32). On a side profile, as depicted in FIG. 3, the upper passageway 45 forms a V-shaped flow path through both sides of the upper portion 25. As will be understood by a person skilled in the art, having two orifices from the lower body moving coolant into the upper body provides more flow options than with a single orifice.

At the same time, coolant will flow through the lower body in a plurality of lower passageways to cool the engine. A portion of coolant flows from the coolant inlet, through the first longitudinal section, and into the lower portion 35 via the lower passageway 55. Once coolant enters the lower passageways, it flows from the exterior side and to the interior side of the engine, exiting the coolant exit out the front of the engine. As will be discussed in further detail below, the lower passageways surround the hottest engine components. Coolant through the lower passageways absorbs this heat and moves it out of the engine.

Once the vehicle has sufficiently warmed up, the vehicle may now be operated in a wide open throttle mode, in which the engine is requiring the maximum amount of air and fuel flow to produce power for vehicle speed. Of course, this is when the engine will also be the hottest due to combustion. During the wide open throttle mode, the plurality of lower passageways (e.g., lower passageway 55), and also upper passageways, route heat away from the combustion components and lower the temperature of exhaust gases through the exhaust gas valve to reduce fuel enrichment and, hence, improve fuel efficiency. This may also occur during a towing mode of the vehicle. While the lower passageways route heat away from the combustion components during both the vehicle warm up mode and the wide open throttle mode, more heat may be routed away during the wide open throttle mode as more heat is produced.

Figure 4:
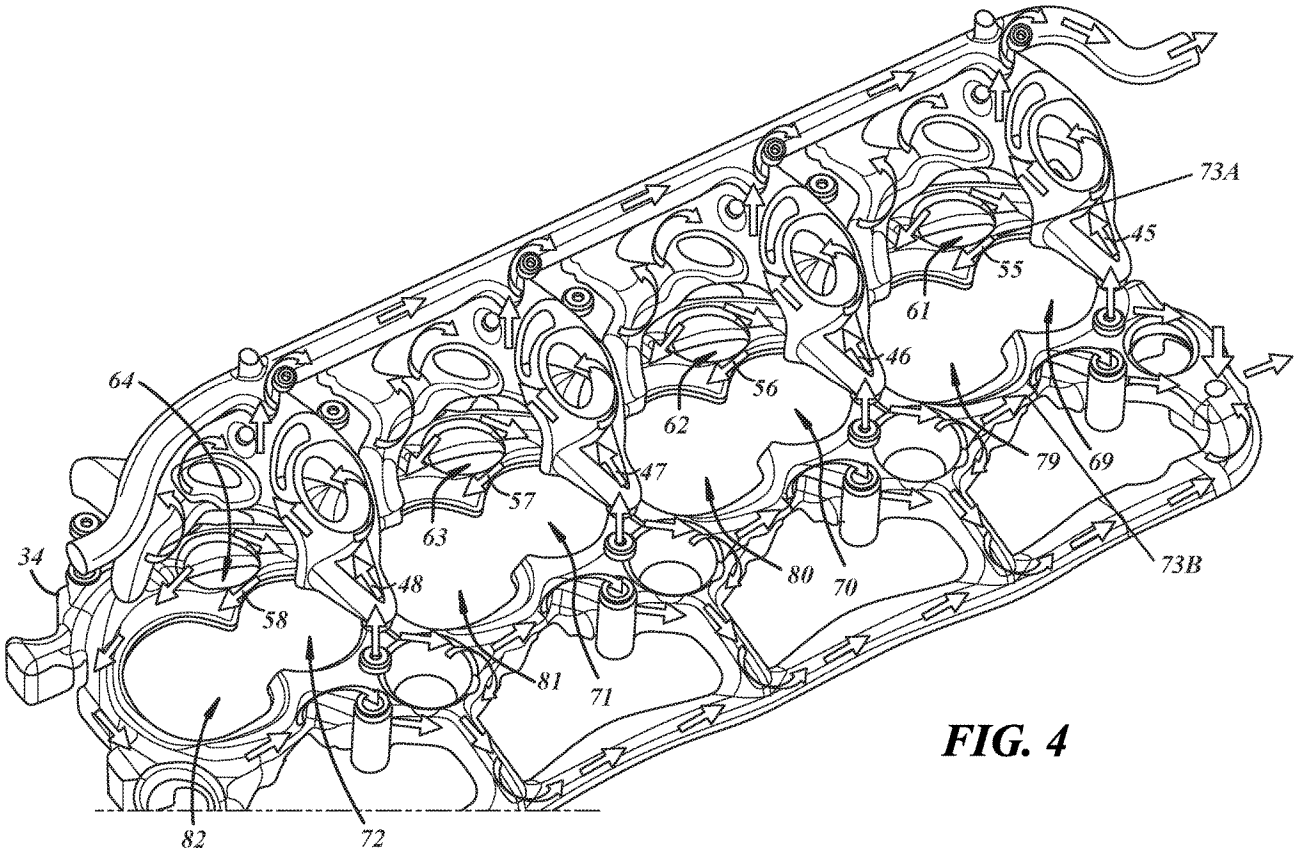
FIG. 4 is a rear, exploded, perspective view of the cooling jacket of FIG. 1.

FIG. 4 depicts a rear, exploded, perspective view of the cooling jacket, showing coolant flow through four lower passageways (55, 56, 57, 58) and four upper passageways (45, 46, 47, 48). Each upper passageway (45, 46, 47, 48) has a parallel coolant flow therethrough when compared to the other upper passageways. Similarly, each lower passageway (55, 56, 57, 58) has a parallel coolant flow therethrough when compared to the other lower passageways.

More specifically, each lower portion has an exhaust opening (69, 70, 71, 72) for an exhaust gas valve and an intake opening (79, 80, 81, 82) for an air intake valve in the valve train of each cylinder. In the lower passageways, coolant flows from an entry (e.g., entry 73A) adjacent the exhaust opening to an exit (e.g., exit 73B) adjacent the intake opening. In each lower passageway, coolant flows at least partially around the perimeter of the exhaust and intake openings, from an exterior to an interior side of the engine. If the openings are generally circular, as depicted in FIG. 4, coolant will flow circumferentially around the openings. In this way, coolant entering lower passageway 55 flows from the entry 73A to the exit 73B.

Additionally, each lower portion has a spark plug opening (61, 62, 63, 64) for a spark plug. Each lower passageway at least partially surrounds the spark plug, exhaust, and intake openings, and permits coolant to flow from a location (e.g., a first location) adjacent the spark plug opening, to a location (e.g., a second location) adjacent the exhaust opening, and to a location (e.g., a third location) adjacent the intake opening, respectively. As combustion occurs, the spark plug is at least one of the hottest component in the cylinder block, followed by the exhaust valve. In this cooling jacket, cold coolant enters each lower passageway, first, near the spark plug opening so that the coolant absorbs the most heat from the spark plug. Next, the coolant flows to and surrounds the exhaust valve, absorbing further heat here. Only after absorbing heat from the spark plug and the exhaust valve does the coolant flow around the air intake valve, which is relatively cooler than the other components. After absorbing this heat, coolant flows out the coolant exit on the interior side of the engine. With this cooling jacket configuration, coolant can target the hottest portions first, being generally from the exhaust valve to the intake valve.

By forming the cooling jacket in the cylinder head and surrounding the combustion components of each cylinder (e.g., spark plug, exhaust gas valve, air intake valve), the cooling jacket can move and/or redistribute heat from the engine better than a cooling jacket that is only located within the cylinder block, for example. The cooling jacket has more surface area in contact with the hottest combustion components, and moves coolant so that the coldest coolant contacts the hottest components first. The passageways (upper and/or lower) are designed to extract heat at the source of heat generation to prevent dissipation of heat to other sections of the heat to minimize thermal gradient in the engine (e.g., cylinder head) and, hence, minimize head distortion.

Just as with the upper passageways, the pump flow rate, associated pressure, and sized orifices within the cooling jacket can permit an equal amount of coolant to be distributed to each lower passageway at the same time. The lower passageways can be isolated from each other so that coolant does not flow directly from one lower passageway to another. Coolant distributed to one of the lower passageways does not flow directly into another of the lower passageways. In this way, coolant enters each lower passageway in a parallel manner from the coolant inlet and first longitudinal section of the lower body. Each lower portion can also have the steam holes described above with the upper portions.

As will be apparent to one skilled in the art, allowing each upper portion and each lower portion to be isolated from the respective adjacent portions, and using parallel flow paths, allows the cooling jacket to efficiently use the cold coolant so that coolant already heated from various parts of the engine is routed out of the engine for cooling or use elsewhere. Additionally, these isolated and parallel passageways allow a lower pressure drop through the engine, as compared with a conventional engine, so that an electric coolant pump can move coolant through the engine and improve fuel economy.

Figure 5:
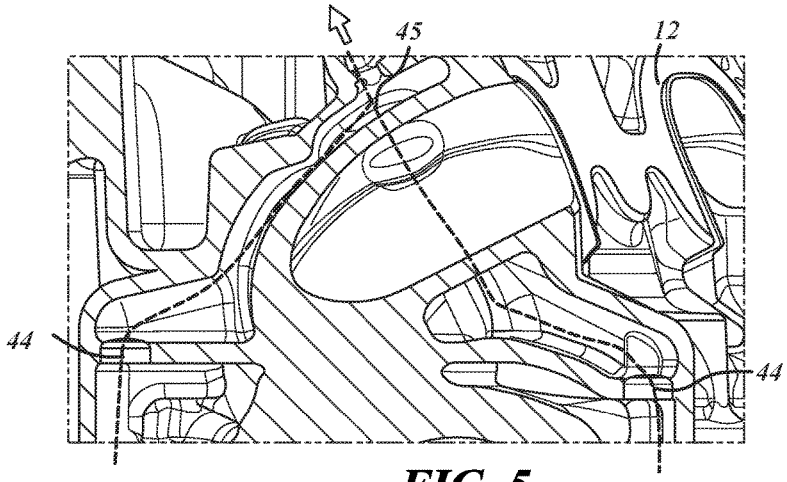
FIG. 5 is an interior view of the cooling jacket of FIG. 1.

By precise sizing of the orifices, the available interior volume in each passageway, and the pump, coolant can be directed and/or routed in a precise and targeted manner within the cooling jacket. For example, FIG. 5 shows an interior view of the cooling jacket, depicting plugs 44 controlling flow through upper passageway 45.

As discussed above, the cooling jacket may be sand cast within the cylinder head 12. Additionally, the upper and lower bodies are formed substantially within the cylinder head and in a single casting so that the majority of the cooling jacket is located within the cylinder head 12. Any portion of the cooling jacket that protrudes out below the cylinder head 12 and into the cylinder block is minimal, taking into account engineering and manufacturing tolerances.

Figure 6:
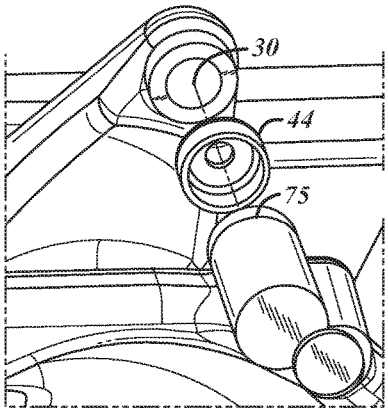
FIG. 6 is an exploded view of a plug of the cooling jacket of FIG. 1.

FIG. 6 depicts an exploded view of plug 44 between lower and bottom orifices (75, 30). An engine assembly, having a cylinder head and a plurality of in-line cylinders, can contain the cooling jacket having the upper and lower bodies, as described herein. The upper body is configured to fit between the upper and lower ends of the cylinder head and has a plurality of upper portions. The lower body is located below the upper body, and has a plurality of lower portions. Each lower portion has a plurality of openings including an exhaust opening for an exhaust gas valve and an intake opening for an air intake valve. A portion of the lower orifices of the lower portions are aligned with the respective one of the bottom orifices.

Each upper portion has at least one upper passageway extending through that upper portion from the respective bottom orifice to the respective top orifice so that the coolant entering the upper passageway of that upper portion flows through the upper portion to the respective top orifice. Additionally, each lower portion has at least one lower passageway extending through that lower portion from an entry adjacent the exhaust opening to an exit adjacent the intake opening so that the coolant entering the lower passageway of that lower portion flows from the entry to the exit.

While the figures depict a cooling jacket for four cylinders, it will be understood that the cooling jacket could be modified to accommodate any number of engine cylinders. Additionally, the cooling jacket described herein can be used for an in-line engine or a V engine configuration. In the case of a V engine configuration, the engine could have two, identical and/or mirror image cooling jackets positioned in the engine. In one example, this cooling jacket is designed and/or configured to accommodate cylinders in which each cylinder has only one exhaust gas valve and only one air intake valve. Of course, it can also be designed and/or configured to accommodate cylinders with multiple exhaust gas and air intake valves in each cylinder. The cooling jacket described herein could be used in an overhead valve (OHV) style engine It is to be understood that the foregoing is a description of one or more aspects of the disclosure. The disclosure is not limited to the particular embodiment(s) disclosed herein, but rather is defined solely by the claims below. Furthermore, the statements contained in the foregoing description relate to particular embodiments and are not to be construed as limitations on the scope of the disclosure or on the definition of terms used in the claims, except where a term or phrase is expressly defined above. Various other embodiments and various changes and modifications to the disclosed embodiment(s) will become apparent to those skilled in the art. All such other embodiments, changes, and modifications are intended to come within the scope of the appended claims.

As used in this specification and claims, the terms "e.g.," "for example," "for instance," "such as," and "like," and the verbs "comprising," "having," "including," and their other verb forms, when used in conjunction with a listing of one or more components or other items, are each to be construed as open-ended, meaning that the listing is not to be considered as excluding other, additional components or items. Other terms are to be construed using their broadest reasonable meaning unless they are used in a context that requires a different interpretation.

What is claimed is:

1. A cooling jacket for an engine having a cylinder head with upper and lower ends, the cooling jacket comprising:

an upper body configured to fit between the upper and lower ends and comprising a plurality of upper portions, each upper portion having a top orifice and a bottom orifice formed therein; and a lower body located below the upper body, the lower body comprising a plurality of lower portions, each lower portion being associated with a respective one of the upper portions and having a lower orifice formed therein and aligned with a respective one of the bottom orifices so as to permit a coolant to flow through the lower orifice and into the bottom orifice such that the coolant flows from that lower portion to the respective one of the upper portions;

wherein each upper portion has at least one upper passageway extending through that upper portion from the bottom orifice to the top orifice so that the coolant entering the upper passageway of that upper portion flows through the upper portion to the top orifice; and wherein the lower body includes a coolant inlet and a first longitudinal section that fluidly connects the coolant inlet to each of the lower orifices.

2. The cooling jacket of claim 1, wherein the lower body includes a coolant outlet fluidly connected via the first longitudinal section and a second longitudinal section of the lower body to the coolant inlet such that one portion of the coolant flows from the coolant inlet, through the first longitudinal section, through the lower orifices, and into the upper passageways, and another portion of the coolant flows from the coolant inlet, through the second longitudinal section, and to the coolant outlet, whereby the cooling jacket includes a first set of parallel coolant flow paths through the upper body and a second set of parallel coolant flow paths through the lower bodies.

3. The cooling jacket of claim 1, further comprising an exit body fluidly coupled to the upper and lower bodies and to redistribute heat from the coolant to one of engine oil, transmission oil, or a vehicle cabin, and each upper passageway being formed from the lower body, into the upper body, and out the exit body.

4. The cooling jacket of claim 1, wherein the upper passageway of each upper portion is isolated from the upper passageway of the other upper portions, and wherein the cooling jacket is configured to distribute an equal amount of the coolant to each of the upper passageways.

5. The cooling jacket of claim 1, wherein the lower body includes a plurality of lower passageways therethrough.

6. The cooling jacket of claim 5, wherein each lower portion has a spark plug opening for a spark plug, an exhaust opening for an exhaust gas valve, and an intake opening for an air intake valve, and each lower passageway permits the coolant to flow from a location adjacent the spark plug opening, to a location adjacent the exhaust opening, and to a location adjacent the intake opening, respectively.

7. The cooling jacket of claim 1, wherein the upper and lower bodies are formed substantially within the cylinder head and in a single casting.

8. A cooling jacket for an engine having a plurality of cylinders and a cylinder head with upper and lower ends, the cooling jacket comprising:

an upper body configured to fit between the upper and lower ends and comprising a plurality of upper portions, each upper portion having a top orifice and a bottom orifice formed therein and surrounding respective valves for one of the cylinders; and a lower body located below the upper body, the lower body comprising a plurality of lower portions, each lower portion being associated with a respective one of the upper portions and having a lower orifice formed therein and aligned with a respective one of the bottom orifices, each lower portion also having a plurality of openings including an exhaust opening for an exhaust gas valve and an intake opening for an air intake valve;

wherein each lower portion has at least one lower passageway extending through that lower portion from an entry adjacent the exhaust opening to an exit adjacent the intake opening so that the coolant entering the lower passageway of that lower portion flows from the entry to the exit.

9. The cooling jacket of claim 8, wherein each lower portion has a spark plug opening for a spark plug, and each lower passageway surrounds the spark plug, exhaust, and intake openings and permits the coolant to flow from a location adjacent the spark plug opening, to a location adjacent the exhaust opening, and to a location adjacent the intake opening, respectively.

10. The cooling jacket of claim 8, wherein the upper and lower bodies are formed substantially within the cylinder head and in a single casting.

11. The cooling jacket of claim 8, wherein coolant flows in the lower passageways during both a vehicle warm-up mode and a wide open throttle mode.

12. The cooling jacket of claim 8, wherein the plurality of lower portions are arranged in-line with each other.

13. The cooling jacket of claim 8, wherein the lower passageway of each lower portion is isolated from the lower passageway of the other lower portions, and wherein the cooling jacket is configured to distribute an equal amount of the coolant to each of the lower passageways.

14. The cooling jacket of claim 8, wherein each cylinder has only one exhaust gas valve and only one air intake valve.

15. The cooling jacket of claim 14, wherein the upper and lower bodies surround the respective valves for one of the cylinders and extract heat and lower a temperature around the only one exhaust gas valve, whereby the cooling jacket improves fuel efficiency during the wide open throttle mode.

16. An engine, comprising:

a cylinder head having upper and lower ends;

a plurality of in-line cylinders arranged adjacent to the cylinder head;

a cooling jacket, comprising:

an upper body configured to fit between the upper and lower ends and comprising a plurality of upper portions, each upper portion having a top orifice and a bottom orifice formed therein and surrounding respective valves for one of the cylinders; and a lower body located below the upper body, the lower body comprising a plurality of lower portions, each lower portion being associated with a respective one of the upper portions and having a lower orifice formed therein and aligned with a respective one of the bottom orifices, each lower portion also having a plurality of openings including an exhaust opening for an exhaust gas valve and an intake opening for an air intake valve;

wherein each upper portion has at least one upper passageway extending through that upper portion from the bottom orifice to the top orifice so that the coolant entering the upper passageway of that upper portion flows through the upper portion to the top orifice; and wherein each lower portion has at least one lower passageway extending through that lower portion from an entry adjacent the exhaust opening to an exit adjacent the intake opening so that the coolant entering the lower passageway of that lower portion flows from the entry to the exit.

17. The engine of claim 16, further comprising an electric pump fluidly coupled to the cooling jacket for circulating coolant through the cooling jacket.

18. The engine of claim 16, wherein a velocity of coolant is substantially equal through each of the bottom and lower orifices.

19. The cooling jacket of claim 16, wherein the upper and lower bodies are formed substantially within the cylinder head and in a single casting.

* * * * *